US006722511B1

(12) United States Patent
Lowe

(10) Patent No.: US 6,722,511 B1
(45) Date of Patent: Apr. 20, 2004

(54) MOUNTABLE HANGER APPARATUS AND KIT OF PARTS THEREFORE

(76) Inventor: Richard B. Lowe, 5108 Riverview Dr., Indianapolis, IN (US) 46208

( * ) Notice: Subject to any disclaimer, the term of this patent is extended or adjusted under 35 U.S.C. 154(b) by 0 days.

(21) Appl. No.: 10/331,377

(22) Filed: Dec. 30, 2002

(51) Int. Cl.[7] ..... A47F 5/08
(52) U.S. Cl. ..... 211/119.004; 211/96
(58) Field of Search ..... 211/96, 119.004, 211/168, 100

(56) References Cited

U.S. PATENT DOCUMENTS

| | | | | |
|---|---|---|---|---|
| 914,697 | A | | 3/1909 | Bryant |
| 1,435,110 | A | | 11/1922 | Efford |
| 1,818,761 | A | | 8/1931 | Sendler |
| 1,837,692 | A | | 12/1931 | Thomas |
| 2,176,723 | A | | 10/1939 | Sauer |
| 2,270,802 | A | | 1/1942 | Kristensen |
| 2,561,806 | A | | 7/1951 | Mailland |
| 2,595,521 | A | | 5/1952 | Hanson |
| 2,633,997 | A | | 4/1953 | Johnson |
| 2,684,225 | A | | 7/1954 | Johnson |
| 2,732,161 | A | | 1/1956 | Moriarty |
| 2,895,698 | A | | 7/1959 | Palmer |
| 3,044,630 | A | | 7/1962 | Szabo |
| 3,175,696 | A | | 3/1965 | Milbourne |
| 3,825,127 | A | | 7/1974 | Morrison |
| 4,721,212 | A | | 1/1988 | Lowe |
| 5,085,389 | A | | 2/1992 | Levesque |
| 5,897,086 | A | | 4/1999 | Condon |
| 6,158,360 | A | * | 12/2000 | Cheng ..... 211/96 X |
| 6,196,398 | B1 | | 3/2001 | Lowe |
| 6,568,546 | B1 | * | 5/2003 | Huang ..... 211/205 |

* cited by examiner

*Primary Examiner*—Robert W. Gibson, Jr.

(57) ABSTRACT

Mountable hanger apparatus (10) and a kit of parts (71) therefore for affixing preferably to door hinges. The hanger apparatus comprises an elongated member (11) having top (13), intermediate (14, 36), and bottom end member segments (15), all of which are longitudinally interconnectable along the longitudinal axis (12) of the elongated member. The elongated member also includes top (42), intermediate (46), and bottom (45) connectors for longitudinally interconnecting the member segments along the member axis. Radially extending support arms (39–41) each connect to a connector so as to rotate about the member axis independent of each other. Top and bottom mounting brackets (16, 24) each slideably receives and connects to a corresponding member segment and also to, for example, a door hinge. The mounting brackets slide along the member segments for adjusting the distance therebetween to fit any door hinge spacing.

25 Claims, 5 Drawing Sheets

55
12
16
62
20
22
10
13
42
23
40
21
57
14
60
56
46
39
61
36
69
11
39
46
36
46
39
36
45
41
24
28
15
31
30
29
12
55

MOUNTABLE HANGER APPARATUS AND KIT OF PARTS THEREFORE

CROSS-REFERENCE TO RELATED APPLICATIONS

This application is related to my earlier filed application of the same title, Ser. No. 10/066,903, filed Feb. 4, 2002.

FIELD OF THE INVENTION

This invention relates to hanger apparatus that is mountable on a door, frame, wall, hinges, and the like and, in particular, to mountable hanger apparatus of which the support arms can swivel or rotate independent of each other and a kit of parts therefore.

BACKGROUND OF THE INVENTION

Individuals are often searching for additional space in their homes to hang articles of clothing (such as coats, towels and other articles) due to the lack of closet space or overcrowded closets or simply for organization or ease of access in a specific location.

Many prior art devices designed for attachment to or supported by door hinges for the placement and storage of articles have been proposed. Early devices were designed to be clamped onto hinge pins of doors for supporting devices such a clothes drying racks, as evidenced by U.S. Pat. No. 2,595,521 to Hanson. However, as shown in the Hanson structure, the clothes drying rack was only useful in supporting small articles. A more recent device shown by U.S. Pat. No. 2,684,225 to Johnson is designed to be clamped on the ends of door hinges for support of an elongated rod which has a plurality of support racks extended therefrom for supporting clothes hangers, shelves, tie racks, and other appliances and devices. However, the Johnson device is designed to be attached to the door hinge by clamping a support bracket shown in FIG. 2, around each end of the door hinge pin, and, therefore, cannot support very much weight.

A still further device is shown in U.S. Pat. No. 3,175,696 to Milbourne, which replaces the door hinge pin itself with an extended end portion of a support frame. Simplified versions of door hinge pin supported devices are shown in U.S. Pat. Nos. 2,270,802 to Kristensen and 3,044,630 to Szabo.

Although each of the foregoing prior art devices disclose article hangers and article storage devices designed to be supported by or as a replacement for door hinge pins to store articles behind a door, each of the prior art devices presents certain drawbacks to their use. For example, the Hanson and Johnson devices cannot support any significant weight, due to the fact that they are designed to be clamped over the ends of the door hinge pins. The device disclosed by Milbourne cannot support a great amount of weight, due to the fact that the longitudinal axis of the main support bar is spaced a great distance from the longitudinal axis of the hinge pins thereby reducing its rigidity. The early prior art devices of Kirstensen and Szabo present small singular hook devices that only provide for a minimal amount of storage for support of a minimal number of articles.

One solution to the need for extra hanging space is disclosed in my previous U.S. Pat. No. 4,721,212 entitled "Modular Article Support Unit" issued on Jan. 26, 1988. This patent discloses a modular article support unit comprising an elongated tubular member adapted to be removably attached to the hinge pins of a door by means of adjustable brackets. The elongated tubular member has a plurality of holes along the length thereof for removably attaching several different types of support devices such as coat hooks, towel racks, bulletin boards, and mirrors. While this invention has adequately served the need for hanging space for several years, there are some disadvantages with the same. For example, the modular article support unit must be mounted in a fixed location, i.e., in the hinges of a door. This limits an individual's ability to locate the support unit in any desired location. Further, the support devices attached to the support unit are likewise limited in that they are fixedly mounted thereto.

Another solution to the need for extra hanging space is disclosed in another patent of mine U.S. Pat. No. 6,196,398, entitled "Hanger Apparatus and Method of Mounting the Same" issued on Mar. 6, 2001. The hanger apparatus comprises two end poles each having an angled mounting bracket attached thereto. Mounted between each end pole is a plurality of middle poles or spacers and a plurality of hanger bars pivotally mounted between the end poles and middle poles. The angled brackets of the end poles are situated in such a manner to allow flexibility and ease in mounting the hanger apparatus in a door jam or door frame at any location along the door frame and along either side of the door frame without interfering with the use of the door. The angled brackets further allow the hanger apparatus to be mounted to a wall. This hanger apparatus is flexible in mounting, as well as easy to mount. The hanger apparatus also has independently movable hanger bars. Although this hanger apparatus serves the user well, one drawback is that it contains a multitude of parts for the user to assemble.

SUMMARY OF THE INVENTION

The foregoing problems are solved and a technical advance is achieved in an illustrative embodiment of mountable hanger apparatus and a kit of parts therefore of the present invention in which the number of parts needed to be assembled is advantageously reduced over that of its predecessor. Furthermore, the direct interconnection of the hanger apparatus elongated member parts provides a sturdy construct in which the article support arms can pivot, swivel or rotate independent of each other. The mountable hangar apparatus comprises an elongated member having a longitudinal axis, a top end member segment, at least one intermediate member segment (preferably 2 or more), and a bottom end member segment. Advantageously, all of the member segments are longitudinally connectable along the longitudinal axis. The member also includes a top connector longitudinally interconnectable with and rotatable with respect to the top end segment and the intermediate segment along the longitudinal axis. The member further includes a bottom connector longitudinally interconnectable with and rotatable with respect to the intermediate member segment and the bottom end member segment along the longitudinal axis.

The apparatus also comprises top and bottom supports arms connectable with the top and bottom connectors, respectively, and radially extendable from the longitudinal axis. In another aspect, the apparatus can include additional connectors and intermediate member segments positioned in the elongated member on the longitudinal axis to advantageously increase the length of the hanger apparatus of which additional support arms are connectable to the added connectors for providing additional support arms on which to place towels and articles of clothing. In addition, the support arms are advantageously rotatable or pivotal about the longitudinal axis of the elongated member independent of each other. The hanger apparatus also includes top and bottom mounting brackets each having a first or an enlarged bracket end that is slideably connectable with the top and bottom end member segments, respectively. The second or smaller bracket end of each mounting bracket is connectable with a wall, door, frame, hinge, or the like. Most often, the smaller ends of the brackets are each attached to a door hinge by way of the door hinge pin for advantageous rotation of the hanger apparatus with respect to the door and the doorframe. Since the mounting brackets are slideably connectable with the end member segments, the longitudinal or vertical distance between the mounting brackets can be advantageously adjusted to accommodate just about any spacing between the door hinges of with the hanger apparatus is to be mounted to.

For ease of assembly and independent rotation or pivoting of the support arms, the end portions of the connectors and member segments are directly interconnectable both rotatably and longitudinally with one another along the longitudinal axis. The end portions of the member segments and connectors are threaded to advantageously facilitate interconnection and independent rotation of the connectors from which the support arms are radially extendable.

For like ease of assembly, the end portions of the support arms include a plurality of threads for interconnecting with another plurality of threads in the corresponding connector that are transverse to the longitudinal axis. The support arms are each connectable with a respective connector for radial extension from the elongated member of the apparatus and independent rotation of the support arms with respect to each other.

For adjusting the distance between the mounting brackets, each enlarged bracket end of the brackets includes a transverse member bore that slideably receives an end member segment. Each transverse member bore includes a beveled counterbore having an included angle ranging from 4° to 12°. In addition, the hanger apparatus further comprises first and second compressible material O-ring seals positionable around the top and bottom end member segments and in the counterbore of each mounting bracket. To advantageously fix the vertical position of the hanger apparatus when mounted on, for example, a pair of door hinges, each enlarged bracket end includes a shoulder disposed between the transverse member bore and the beveled counterbore. The O-ring seal is positionable on the shoulder to be advantageously compressed and fix the relative position of the end segments with respect to the mounting brackets. With such a compression friction fit of the O-ring seals between the mounting bracket and the member end segments, the preferred included angle of the counterbore is 8°.

Alternatively, the mounting brackets can include a setscrew that is extendable into the transverse member bore to engage with and fixedly position an end member segment thereto.

The present invention also includes a kit of mountable hanger apparatus parts as previously and hereinafter described.

In another aspect of the present invention, the connectable or interconnectable parts of the hanger apparatus are connected to form a mountable hanger apparatus for connecting to a wall, door, frame, hinge, or the like.

DETAILED DESCRIPTION

Figure 1:
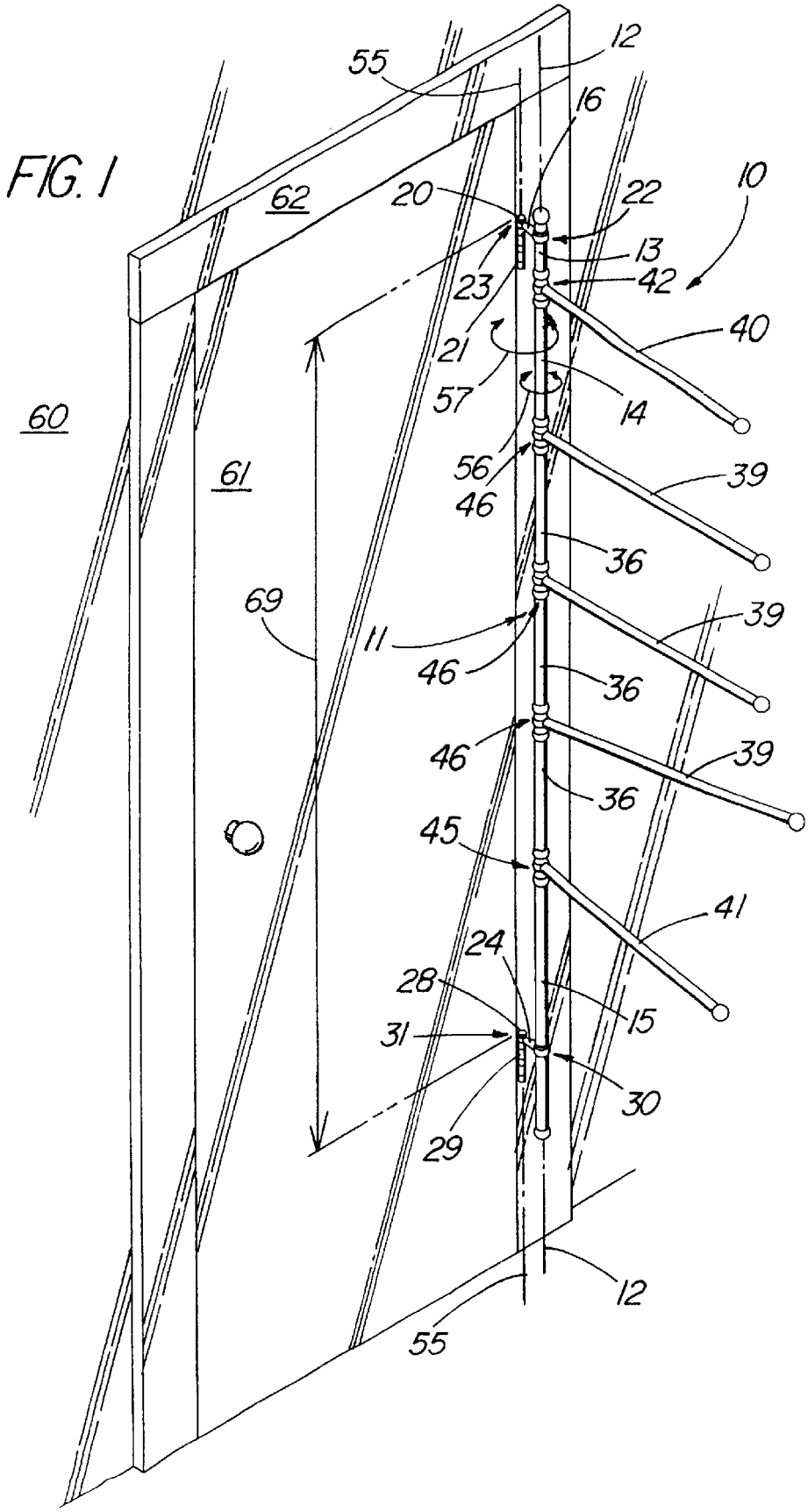
FIG. 1 depicts a pictorial view of a preferred illustrative embodiment of mountable hanger apparatus of the present invention mounted on door hinges.

FIG. 1 depicts a pictorial view of a preferred illustrative embodiment of mountable hanger apparatus 10 of the present invention mounted on top and bottom door hinges 21 and 29, which are positioned between door 61 and doorframe 62 in wall 60. The hanger apparatus comprises an elongated member 11 having a longitudinal axis 12. The elongated member further includes a first or top end member segment 13 and a second or bottom end member segment 15. The elongated member still further includes one or more intermediate member segments 14 and 36, which are disposed between top and bottom end member segments 13 and 15. All of the end and intermediate member segments are longitudinally connectable along longitudinal axis 12. Elongated member 11 further includes a plurality of similarly constructed connectors such as top connector 42, bottom connector 45, and one or more intermediate connectors 46 for longitudinally interconnecting the top end, intermediate and bottom end member segments 13; 14, 36; and 15. A first or top support arm 40 is connectable to top connector 42 and radially extendable from the longitudinal axis for hanging articles of, for example, clothing or towels thereon. A second or bottom support arm 41 is connectable to bottom connector 45 and likewise radially extendable from the longitudinal axis. One or more intermediate support arms 39 are each connectable to an intermediate connector 46 and radially extendable therefrom. All of the support arms are each rotatable about the longitudinal axis of the elongated member independent of each other. Preferably, all the support arms are equivalent for ease of manufacture; however, the length of arms can be varied to address desired user needs. Other embodiments of supports such as hooks, tie/towel racks, grid support, mirror or bulletin/blackboard assemblies or frames that are connectable to the connectors of the elongated member are contemplated and disclosed in U.S. Pat. No. 4,721,212 of mine and incorporated by reference herein. Each of the elongated member segments and connectors along with the extendable support arms are rotatable or pivotal about longitudinal axis 12 independent of each other when the hanger apparatus and, in particular, each of the top and bottom end member segments, is connected to, for example, a wall 60, door 61, frame 62, hinge 21, 29 and the like via top and bottom mounting brackets 16 and 24.

First or top mounting bracket 16 is slideably connectable preferably with top end member segment 13. However, the bracket is also slideably connectable with any intermediate member segment. The top mounting bracket is preferably a straight arm extending radially, i.e. transversely at a right angle, from the elongated member for rotatably connecting top end member segment 13 to top door hinge 21. The top mounting bracket 16 has a first or enlarged bracket end 22 having a transverse member bore through which top end member segment 13 is slideably positioned therethrough. The mounting bracket also includes a second or smaller bracket end 23 having a transverse hinge pin bore through which a hinge pin 20 is inserted therethrough and into door hinge 21.

Equivalently constructed, a second or bottom mounting bracket 24 has a first or enlarged bracket end 30, which is slideably connectable preferably with bottom end member segment 15. The bottom bracket, as well s the top bracket, is also slideably connectable with an intermediate member segment depending on the desired vertical orientation of the hanger apparatus with respect to the door hinge. The bottom mounting bracket, which is equivalent to the top bracket, extends radially or transversely from the longitudinal axis of the elongated member for connecting to, for example, bottom door hinge 29 via door hinge pin 28 extending through a transverse hinge pin bore in a second or smaller bracket end 31 of the mounting bracket. As a result of these unique mounting brackets, support arms 39–41 are independently rotatable or pivotal about longitudinal axis 12 of the elongated member as depicted by rotation arrow 56. In addition, the elongated member is rotatable about longitudinal axis 55 established by hinge pins 20 and 28 as depicted by rotation arrow 57.

As normally would be expected, top and bottom door hinges 21 and 29 are positioned between door 61 and doorframe 62. As described in U.S. Pat. No. 4,721,212 and incorporated by reference herein, like first and second mounting brackets 16 and 24 are attached to door hinges 21 and 29 of which spacing 69 therebetween can vary from one door to another. This variable spacing 69 between door hinges is accommodated by the slideable connection of the mounting brackets with respect to top and bottom end member segments 13 and 15 of elongated member 11. Although mounting brackets 16 and 24 are preferably for rotatable connection to door hinges, the radially extendable portion of each mounting bracket can readily be adapted for direct attachment to a door, frame, wall, and the like as described in my U.S. Pat. No. 6,196,398 and incorporated by reference herein. In addition, a third or intermediate door hinge can be used to which either the top or bottom mounting bracket can be connected to accommodate unusual door hinge spacing or unusual vertical positioning of the elongated member with respect to the door hinges. In such cases, the top or bottom mounting bracket can be repositioned and slideably connected to an intermediate member segment 14 or 36.

Figure 2:
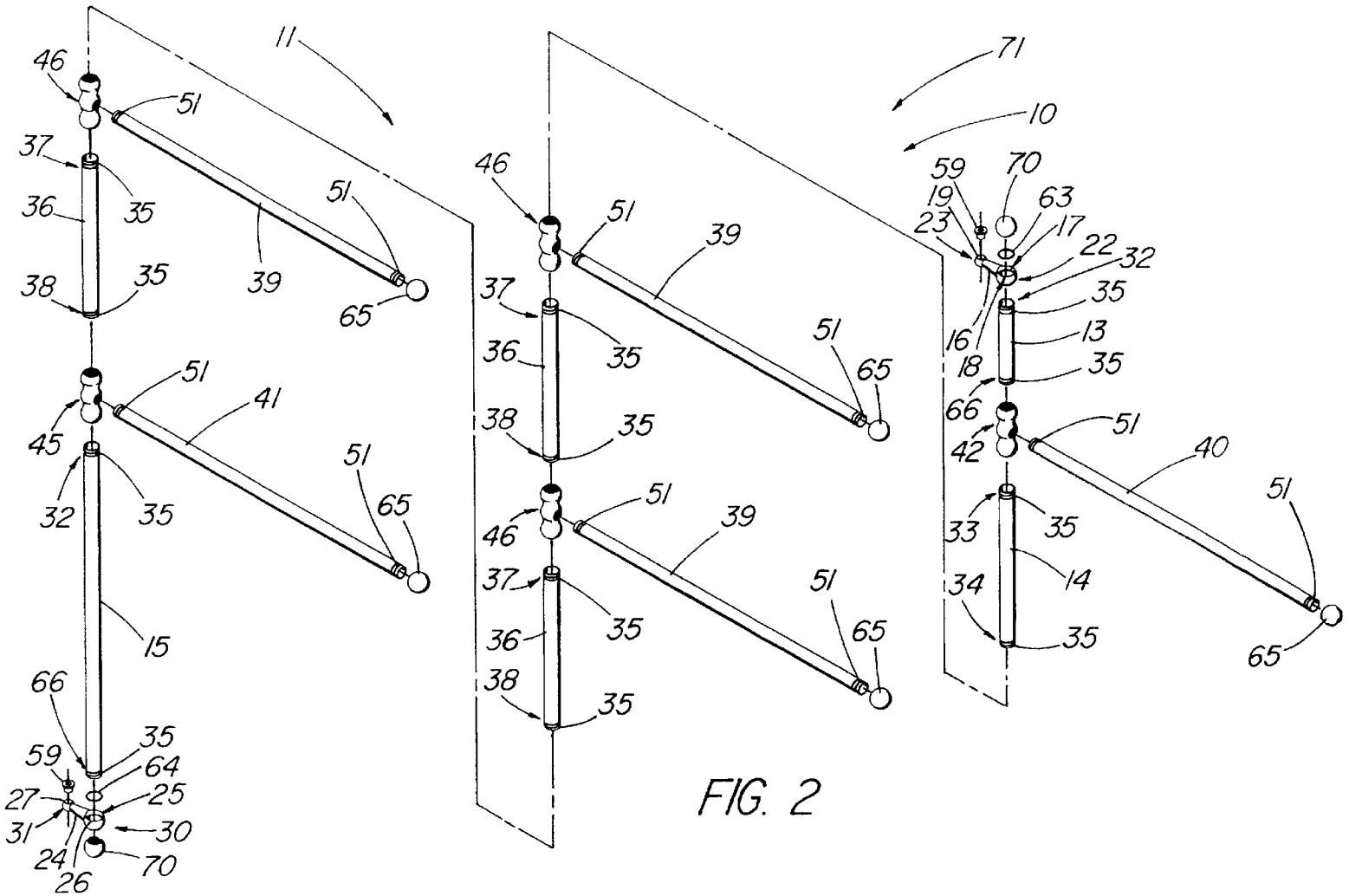
FIG. 2 depicts an exploded view of the mountable hanger apparatus of FIG. 1.

FIG. 2 depicts an exploded view of mountable hanger apparatus 10 of FIG. 1. In this exploded view, essentially all of the parts of the mountable hanger apparatus are depicted. Any combination of all or any of these parts can be included in a kit 71 of mountable hanger apparatus parts, which forms another aspect of the present invention. Elongated member 11 comprises a plurality of tubular, longitudinally connectable member segments 13–15 and 36. Each of the member segments comprises a commercially available ¾ inch outside diameter, 0.650 inch inside diameter, stainless steel pipe or tube having a passage extending longitudinally therethrough. By way of example, top end member segment 13 is approximately 4F inches in length with bottom end member 15 being approximately 19 inches in length. Intermediate member segments 14 and 36 are each approximately 9 inches in length. Each member segment 13, 15; 14; and 36 has a first or top segment end portion 32, 33, and 37 and a second or bottom segment end portion 66, 34 and 38, respectively. Each end portion has a first plurality of threads 35 such as external ¾-20 threads extending in from the end of the pipe approximately ½ inches. The elongated member also includes first or top connector 42, second or bottom connector 45, and one or more intermediate connectors 46, all of which are equivalent, for longitudinally interconnecting the member segments 13–15 and 36.

Figure 4:
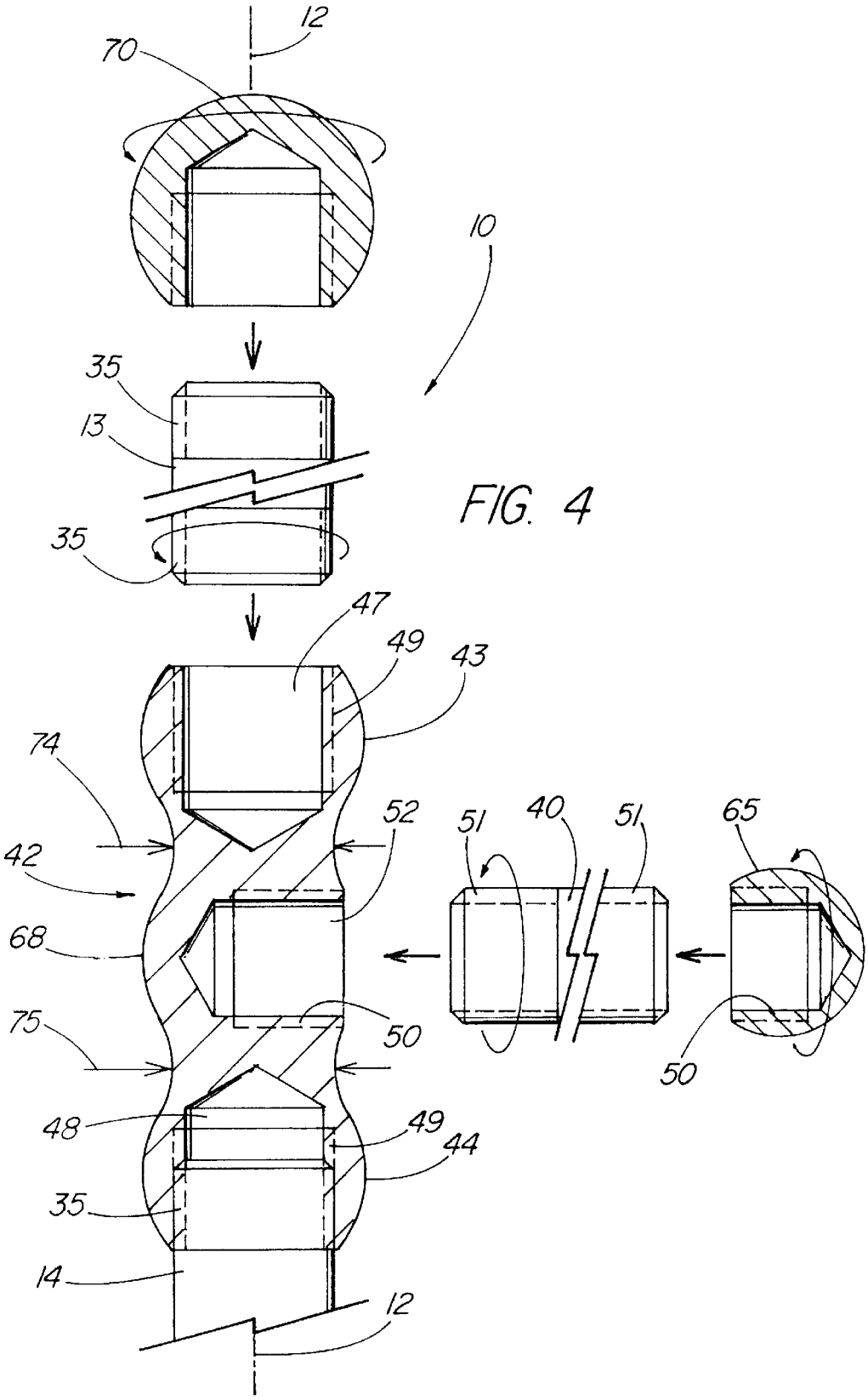
FIG. 4 depicts an enlarged and partially sectioned and disassembled side view of a connector interconnecting two member segments along the longitudinal axis of the mountable hanger apparatus of FIGS. 1 and 2 with a support arm extending radially from the longitudinal axis of the elongated member.

FIG. 4 depicts an enlarged and partially sectioned and disassembled side view of top connector 42 of mountable hanger apparatus 10 of FIGS. 1 and 2. Top end member segment 13 and top support arm 40 are depicted disassembled from the connector, whereas intermediated member segment 14 is rotatably connected to connector 42. Top connector 42, like all the other connectors 45 and 46, is approximately 3 inches long and 1 inch in diameter. Each connector can be formed or cast from a rigid material for example a rigid polymer plastic such as DELRIN plastic or a metal such as aluminum. The connector has two approximate 0.725 inches diameter, equally spaced waists 74 and 75, thus forming first or top connector end portion 43, intermediate connector portion 68, and second or bottom connector end portion 44. Top and bottom connector end portions 43 and 44 each have an approximately 0.750 inches centerline bore 47 and 48, formed therein approximately 0.575 inches deep and along longitudinal axis 12, respectively, with a plurality of internal threads 49 such as ¾-20 threads therein. Top and intermediate member segments 13 and 14, as well as bottom member segment 15, each have a plurality of external threads 35 such as ¾-20 threads thereon for approximately 0.500 inches for rotatably mating with the internal threads 49 of the top and bottom connector end portions 43 and 44, respectively. These threads, of course, match and interconnect with each other to rotate, pivot and/or swivel the connectors with support arms 39–41 extending radially from the longitudinal axis of elongated member 11 as well as connectors 42, 45 and 46. The external threads of the member segments are threaded in the connectors so as not to bottom out on the centerline connector bore. Thus, the connector can rotate, pivot or swivel about the longitudinal axis 12 of the elongated member of the hanger apparatus.

Intermediate connector portion 68 of each connector has a transverse arm bore 52 extending therein approximately 0.590 inches and transverse, preferably at a right angle, to centerline bores 47 and 48 of the connector. The transverse connector bore has an approximate ⅝ inches diameter and a plurality of internal threads 50 such as ⅝-24 threads therein. The end portion of each support arm 39–41 includes a plurality of external threads 51 such as ⅝-24 threads extending approximately ½ inches therein that rotatably mate and connect with internal threads 50 of intermediate connector portion 68, thereby extending radially from the longitudinal axis of the elongated member of the hanger apparatus. However, the transverse connector bore can be positioned at different angles with respect to the centerline bore to provide different support arm orientation with respect to each other and/or the axis of the elongated member. The support arms are intended to thread completely into and tighten into the threads of the transverse arm bore, whereas the threads of the centerline bores and end portions of the member segments are to remain loose so that the support arms can rotate, pivot or swivel about the longitudinal axis of the elongated member.

The hanger apparatus of FIG. 2 also includes first or top, second or bottom, and one or more intermediate support arms 40, 41 and 39 that are connectable with and radially extendable from top, bottom, and intermediate connectors 42, 45 and 46, respectively, as well as the longitudinal axis of the elongated member and connectors. By way of example, support arms 39–41 are each approximately 19 inches in length of commercially available ⅝ inch outside diameter, 0.550 inch inside diameter, stainless steel pipe.

As depicted in FIG. 4 at the free end of each support arm 39–41, an approximately 1 inch metal spherical or ball end cap 65 is threadable thereon with a third plurality of threads 50 such as ⅝-24 internal threads extending approximately 0.562 inches therein. The other end of each support arm 39–41 is threadably connected to a corresponding connector 42, 45 or 46. In similar fashion, a 1-inch metal ball or spherical end cap 70 is threadable on external threads 35 at the top segment end portion 32 and the bottom segment end portion 66 of the elongated member. End cap 70 includes a plurality of internal threads 49 such as ¾-20 internal threads extending approximately 0.5 inches therein.

The hanger apparatus of FIG. 2 further includes top mounting bracket 16 having a first or enlarged bracket end 22 with transverse member bore 17 therethrough for slideably receiving and connecting to top end member segment 13. Transverse member bore 17 includes beveled counterbore 18 in which O-ring seal 63 is positioned to compression fit top end member segment 13 therein. At the second or smaller bracket end 23 of bracket 16 is a transverse hinge pin bore 19 for receiving a door hinge pin therethrough or a plastic spacer 59 for accommodating a smaller diameter hinge pin.

In like fashion to that of top mounting bracket 16, the hanger apparatus of FIG. 2 also includes bottom mounting bracket 24 having a first or enlarged bracket end 30 with transverse member bore 25 therethrough for slideably receiving and connecting to bottom end member segment 15. Transverse member bore 25 includes beveled counterbore 24 in which O-ring seal 64 is positioned to compression fit bottom end member segment 15 therein. This compression fit of the bottom end member segment in the beveled counterbore of the bottom mounting bracket maintains or fixedly positions the relative position of the bracket with respect to the bottom end member segment, particularly, when the bracket is connected to a door hinge and the bottom end member segment is in a vertical position. At smaller bracket end 31 of bracket 24 is a transverse hinge pin bore 27 for receiving a bottom door hinge pin such as hinge pin 28 there through or a plastic spacer 59 for accommodating a smaller diameter hinge pin.

To adjust the spacing between the top and bottom mounting brackets, either one or both of the brackets can be slide along the respective end member segment by pulling down on the bracket or up on the end member segment to release the compression fit of the O-ring seal in the beveled counterbore. Once released, the O-ring seal can be repositioned anywhere along the length of the end member segment. The mounting bracket can then be again compression fitted to the end member segment by sliding the O-ring seal into the beveled counterbore of the mounting bracket. As a result, any desired spacing between the brackets can be achieved along with any vertical orientation of the hanger apparatus with respect to the door hinges. Depending on the number of door hinges and the desired vertical orientation or position of the hanger apparatus with respect thereto, either one or both of the top and bottom mounting brackets 16 and 24 can be positioned and slideably connected to any of the intermediate segments 14 and 36.

Figure 3:
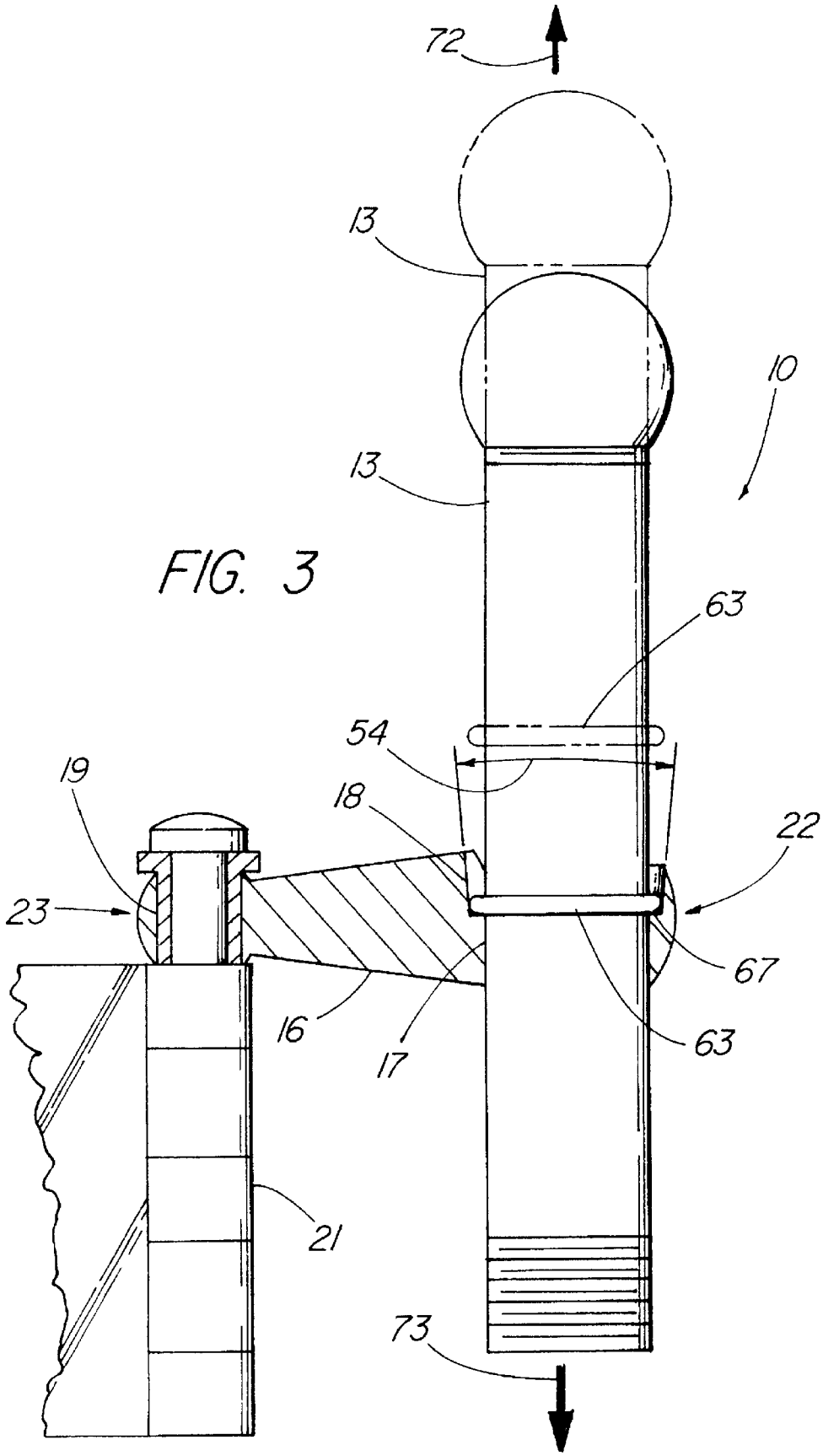
FIG. 3 depicts an enlarged and partially sectioned side view of the top mounting bracket and the top end member segment of the mountable hanger apparatus of FIG. 1 mounted on, for example, a hinge of a door.
Figure 5:
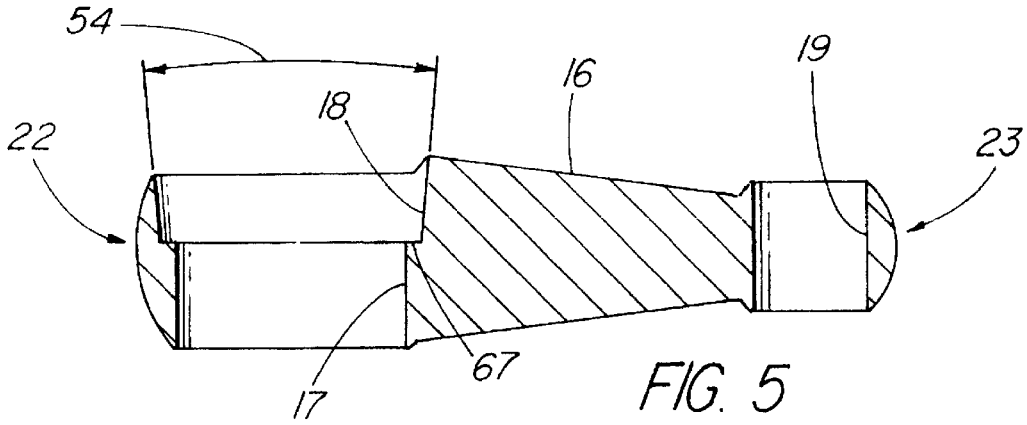
FIG. 5 depicts an enlarged and partially sectioned side view of the mounting bracket of the mountable hanger apparatus of FIGS. 1 and 2 illustrating the included angle of the counterbore.

FIGS. 3 and 5 depict an enlarged and partially sectioned side view of the top mounting bracket 16 of the mountable hanger apparatus of FIGS. 1 and 2. In FIG. 3, the mounting bracket is slideably connected to the top end member segment 13 and connected to the top door hinge 21. The top and bottom mounting brackets are equivalent in size and structure. By way of example, the mounting bracket is approximately 2.75 inches long with spacing of approximately 1.6875 inches between the centers of transverse member bore 17 and transverse hinge pin bore 19. Transverse hinge pin bore 19 has a diameter of approximately 0.375 inches. Smaller bracket end 23 has a height of approximately 0.480 inches. Transverse member bore 17 has an approximate 0.756 inches diameter and rises from the bottom thereof approximately 0.320 inches to shoulder 67.

From shoulder 67, beveled counterbore 18 rises approximately 0.226 inches on the outside of bracket end 22 and has a diameter thereat of approximately 0.8725 inches and rises 0.321 inches on the inside of the enlarged bracket end. The beveled counterbore has an included angle 54 of preferably 8 degrees and preferably ranges from 4 to 12 degrees. The mounting bracket ends are rounded, and the bracket is conically tapered between the smaller and enlarged bracket ends. Top end member segment 13 has an outside diameter of approximately 0.750 inches and is slideably connected to the mounting bracket in transverse member bore 17. O-ring seal 63 is a commercially available, flexible and compressible material seal of, for example, Buna or Buna-N synthetic rubber or elastomer, having an inside diameter of approximately 0.750 inches and an annular ring diameter of approximately 0.050 inches. When top end member segment 13 is fixedly positioned vertically in transverse member bore 17, O-ring seal preferably rests on shoulder 67 and is compressed between the member segment and the inner surface wall of counterbore 18. As the O-ring seal is compressed down onto shoulder 67, a compression friction fit is established with the member segment and the bracket end to fixedly position the three parts with respect to each other. Should the position of the mounting bracket with respect to the end member segment be altered, the end member segment is lifted upward as indicated by arrow 72 with respect to enlarged bracket end 22. The O-ring seal (phantom line 63) is slide up or down as desired to a new position on the end member segment (phantom line 13), which is then together slid in a downward direction as indicated by arrow 73 into beveled counterbore 18 until O-ring seal rests again on shoulder 67. The height of transverse member bore 17 is sufficient to keep the end member segment and the bore in proper alignment, thus preventing the member segment and O-ring seal from getting offset or cocked in beveled counterbore 18 or transverse member bore 17.

Figure 6:
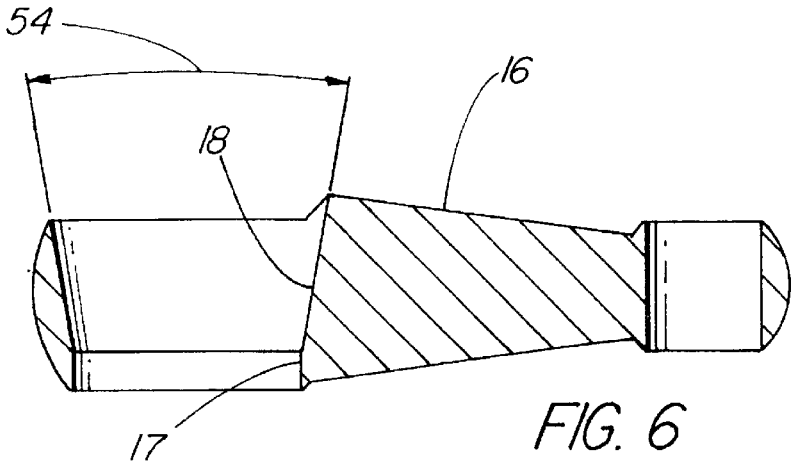
FIG. 6 depicts a sectioned side view of an alternative embodiment of the mounting bracket of the mountable hanger apparatus of FIG. 1.
Figure 7:
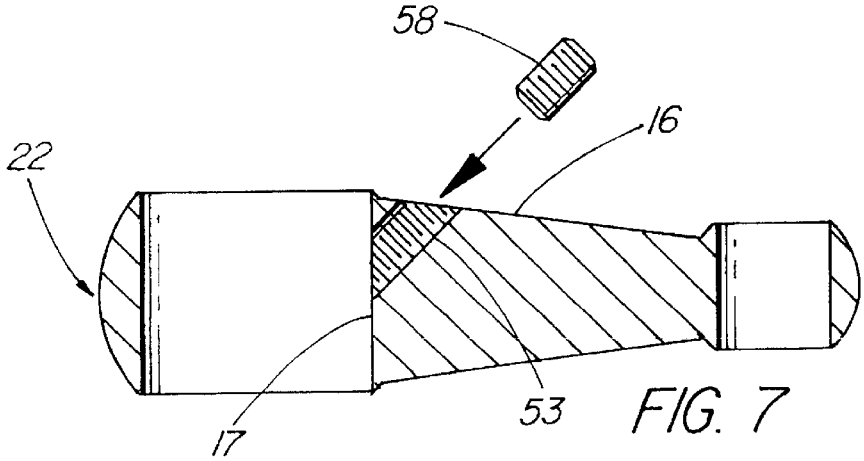
FIG. 7 depicts a sectioned side view of another alternative embodiment of the mounting bracket of the mountable hanger apparatus of FIG. 1 utilizing a setscrew for extension into the transverse member bore of the bracket.

FIGS. 6 and 7 depict partially sectioned side views of alternative embodiments of top or bottom mounting brackets 16 or 24 of FIGS. 3 and 5. In FIG. 6, the height of transverse member bore 17 has been reduced and the height of beveled counterbore increased. There is no shoulder 67 in this alternative embodiment; however, the height and mouth of the beveled counterbore have been increased to permit easier entry of a member segment and O-ring seal therein. In addition, since the shoulder has been eliminated, the O-ring seal can be further compressed.

FIG. 7 depicts a second alternative embodiment of mounting bracket 16 or 24 in which transverse member bore 17 extends uniformly through enlarged bracket end 22 without the presence of a beveled counterbore as in the previously described embodiments of the mounting bracket. However in this embodiment, a threaded setscrew bore 53 is angled into transverse member bore 17 to receive setscrew 58. When a member segment is positioned in transverse member bore 17, the setscrew is turned in to engage the member segment and fixedly position the segment in the mounting bracket.

Although the mountable hanger apparatus has been herein described as a connectable kit of parts and an interconnected apparatus, it is to be understood that the present invention includes a kit of parts at any stage or combination of disassembly or interconnection. Furthermore, a kit of mountable hangar apparatus parts 71 is included as any combination of the aforementioned parts. The following list of parts is merely illustrative and provided for the reader's convenience only and is not to limit or restrict the present invention in any manner.

List of Parts for Mountable Hanger Apparatus

10 Mountable hanger apparatus
11 Elongated member of 10
12 Longitudinal axis of 11
13 First or top end member segment of 11
14 Intermediate member segment of 11
15 Second or bottom end member segment of 11
16 First or top mounting bracket of 10
17 Transverse member bore of 16, 22
18 Beveled counterbore of 16, 17, 22
19 Transverse hinge pin bore of 16, 23
20 Top door hinge pin
21 Top door hinge
22 First or enlarged bracket end of 16
23 Second or smaller bracket end of 16
24 Second or bottom mounting bracket of 10
25 Transverse member bore of 24, 30
26 Beveled counterbore of 24, 25, 30
27 Transverse hinge pin bore of 24, 31
28 Bottom door hinge pin
29 Bottom door hinge
30 First or enlarged bracket end of 24
31 Second or smaller bracket end of 24
32 First or top segment end portion of 13, 15
33 First or top segment end portion of 14
34 Second or bottom segment end portion of 14
35 First plurality of external threads of 32–34,37,38,66
36 Other intermediate member segment of 11
37 First or top segment end portion of 36
38 Second or bottom segment end portion of 36
39 Other or intermediate support arm
40 First or top support arm
41 Second or bottom support arm
42 First or top connector
43 First or top connector end portion of 42,45,46
44 Second or bottom connector end portion of 42,45,46
45 Second or bottom connector
46 Other intermediate connector
47 Top centerline bore of 43
48 Bottom centerline bore of 44
49 Second plurality of threads of 43,44,47,48, 70
50 Third plurality of threads of 52,68
51 Fourth plurality of threads of 39–41
52 Transverse arm bore of 68
53 Threaded set screw bore of 16,24
54 Included angle
55 Longitudinal axis of hinge pins 20,28
56 Rotation arrow about member axis 12
57 Rotation arrow about hinge pin axis 55
58 Setscrew
59 Plastic spacer
60 Wall
61 Door
62 Frame
63 First O-ring seal of 10,16
64 Second O-ring seal of 10,24
65 Ball end cap for support arm
66 Second or bottom segment end portion of 13,15

67 Shoulder of 22,30
68 Intermediate connector portion of 42,45,46
69 Door hinge spacing
70 Ball end caps for elongated member
71 Kit of mountable hanger apparatus parts
72 Up arrow
73 Down arrow
74 Connector waist
75 Connector waist It is to be understood that the embodiments herein described are merely illustrative of the principles of the present invention and that those skilled in the art can devise various modifications of the mountable hanger apparatus and a kit of parts therefore without departing from the spirit or scope of from the claims which follow. It is also contemplated that the parts of the mountable hangar apparatus can be formed from a variety of metal and polymer materials of different lengths and cross-sectional dimensions to meet different needs.

What is claimed is:

1. Mountable hanger apparatus comprising:

an elongated member having a longitudinal axis and including a first end member segment, an intermediate member segment and a second end member segment, all of said member segments being longitudinally connectable along said longitudinal axis, said member also including a first connector longitudinally interconnectable with and rotatable with respect to said first end member segment and said intermediate member segment along said longitudinal axis and a second connector longitudinally interconnectable with and rotatable with respect to said intermediate member segment and said second end member segment along said longitudinal axis, a first and a second support arm connectable with said first and said second connector, respectively, and radially extendable from said longitudinal axis, a first mounting bracket having a first bracket end slideably connectable with said first end member segment and having a second bracket end connectable with at least one of a wall, door, frame, hinge and the like, and a second mounting bracket having a first bracket end slideably connectable with said second end member segment and having a second bracket end connectable with at least one of a wall, door, frame, hinge and the like, whereby said first and said second support arms are each rotatable about said longitudinal axis of said elongated member independent of each other and whereby said first and said second mounting brackets are each slideable along at least said first and said second member end segments, respectively, for adjusting the longitudinal distance between said first and said mounting brackets.

2. The hanger apparatus of claim 1 wherein said first and said second connector each has a first and a second connector end portion, wherein said first and said second end member segment each has a segment end portion, wherein said intermediate member segment has a first and a second segment end portion and wherein each one of the segment end portions is directly interconnectable both rotatably and longitudinally along said longitudinal axis with ore of the first and the second connector end portions.

3. The hanger apparatus of claim 2 wherein said apparatus further comprises an other connector having a first and a second other connector end portion and an other intermediate member segment having a first and a second member end portion each directly interconnectable both rotatably and longitudinally along said longitudinal axis with one of the connector end portions of the connectors and wherein said apparatus also further comprises an other support arm attachable to said other connector and radially extendable from said longitudinal axis.

4. The hanger apparatus of claim 3, wherein each end portion of the member segments includes a first plurality of threads and wherein each connector end portion of the connectors includes a second plurality of threads that is interconnectable with said first plurality of threads.

5. The hanger apparatus of claim 4, wherein each support arm includes a fourth plurality of threads and wherein each connector also includes a third plurality of threads that is interconnectable with the fourth plurality of threads of each support arm.

6. The hanger apparatus of claim 1, wherein each first bracket end of the first and the second mounting brackets includes a transverse member bore that slideably receives an end member segment.

7. The hanger apparatus of claim 6, wherein each transverse member bore includes a beveled counterbore having an included angle in a range from 4° to 12°.

8. The hanger apparatus of claim 7, further comprising a first and a second compressible material O-ring seal positionable around said first and said second end member segments, respectively, and in the beveled counterbore of said first and said second mounting brackets, respectively.

9. The hanger apparatus of claim 8, wherein each first bracket end of the first and the second mounting brackets includes a shoulder between the transverse member bore and the beveled counterbore.

10. The hanger apparatus of claim 9, wherein the first and the second compressible material O-ring seal is positionable on the shoulder between the transverse member bore and the beveled couterbore of the first and the second mounting bracket, respectively.

11. The hanger apparatus of claim 10, wherein the included angle is 8°.

12. The hanger apparatus of claim 6, wherein each of the first and second mounting brackets includes a setscrew extendable into the transverse member bore and engageable with an end member segment.

13. A kit of mountable hanger apparatus parts comprising:

an elongated member having a longitudinal axis and including a first end member segment, an intermediate member segment and a second end member segment, all of said member segments being longitudinally connectable along said longitudinal axis, said member also including a first connector longitudinally interconnectable with and rotatable with respect to said first end member segment and said intermediate member segment along said longitudinal axis and a second connector longitudinally interconnectable with and rotatable with respect to said intermediate member segment and said second end member segment along said longitudinal axis, a first and a second support arm connectable with said first and said second connector, respectively, and radially extendable from said longitudinal axis, a first mounting bracket having a first bracket end slideably connectable with said first end member segment and having a second bracket end connectable with at least one of a wall, door, frame, hinge and the like, and a second mounting bracket having a first bracket end slideably said second end member segment and having a second bracket end attachable to at least one of a wall, door, frame, hinge and the like, whereby said first and said second support arms are rotatable about said longitudinal axis of said elongated member independent of each other and whereby said first and said second mounting brackets are each slideable along at least said first and said second member end segments, respectively, for adjusting the longitudinal distance between said first and said mounting brackets.

14. The kit of parts of claim 13, wherein said first and said second connector each has a first and a second connector end portion, wherein said first and said second end member segment each has a segment end portion, wherein said intermediate member segment has a first and a second segment end portion, and wherein each one of the segment end portions is directly interconnectable both rotatably and longitudinally along said longitudinal axis with one of the first and the second connector end portions.

15. The kit of parts of claim 14, wherein the kit of parts further comprises an other connector having a first and a second other connector end portion and an other intermediate member segment having a first and a second member end portion each directly interconnectable both rotatably and longitudinally along said longitudinal axis with one of the connector end portions of the connectors and wherein said apparatus also further comprises an other support attachable to said other connector and radially extendable from said longitudinal axis.

16. The kit of parts of claim 15, wherein each end portion of the member segments includes a first plurality of threads and wherein each connector end portion of the connectors includes a second plurality of threads that is interconnectable with said first plurality of threads.

17. The kit of parts of claim 16, wherein each support arm includes a fourth plurality of threads and wherein each connector also includes a third plurality of threads that is interconnectable with the fourth plurality of threads of each support arm.

18. The kit of parts of claim 13, wherein each first bracket end of the first and the second mounting brackets includes a transverse member bore that slideably receives an end member segment.

19. The kit of parts of claim 18, wherein each transverse member bore includes a beveled counterbore having an included angle in a range from 4° to 12°.

20. The kit of parts of claim 19, further comprising a first and a second compressible material O-ring seal positionable around said first and said second end member segments, respectively, and in the beveled counterbore of said first and said second mounting brackets, respectively.

21. The kit of parts of claim 13, wherein each first bracket end of the first and the second mounting brackets includes a shoulder between the transverse member bore and the beveled counterbore.

22. The kit of parts of claim 21, wherein the first and the second compressible material O-ring seal is positionable on the shoulder between the transverse member bore and the beveled couterbore of the first and the second mounting bracket, respectively.

23. The kit of parts of claim 22, wherein the included angle is 8°.

24. The kit of parts of claim 16, wherein each of the first and second mounting brackets includes a setscrew extendable into the transverse member bore and engageable with an end member segment.

25. Mountable hanger apparatus comprising:

an elongated member having a longitudinal axis and including a first end member segment, an intermediate member segment and a second end member segment, all of said member segments being longitudinally connected along said longitudinal axis, said member also including a first connector longitudinally interconnecting said first end member segment and said intermediate member segment along said longitudinal axis and a second connector longitudinally interconnecting said intermediate member segment and said second end member segment along said longitudinal axis, a first and a second support arm connected to said first and said second connector, respectively, and radially extending from said longitudinal axis, a first mounting bracket having a first bracket end slideably connected to said first end member segment and having a second bracket end connectable with at least one of a wall, door, frame, hinge and the like, and a second mounting bracket having a first bracket end slideably connected to said second end member segment and having a second bracket end connectable with at least one of a wall, door, frame, hinge and the like, whereby said first and said second support arms are rotatable about said longitudinal axis of said elongated member independent of each other and whereby said first and said second mounting brackets are each slideable along at least said first and said second member end segments, respectively, for adjusting the longitudinal distance between said first and said mounting brackets.

* * * * *